US005617951A

United States Patent [19]

Wick

[11] Patent Number: 5,617,951

[45] Date of Patent: Apr. 8, 1997

[54] GOLF CLUB ORGANIZER FOR A GOLF BAG

[76] Inventor: Philip B. Wick, P.O. Box 3545, Hayden, Id. 83835

[21] Appl. No.: 590,336

[22] Filed: Jan. 23, 1996

[51] Int. Cl.[6] ..... A63B 55/00

[52] U.S. Cl. ..... 206/315.6; 206/315.2; 206/315.3; 211/70.2

[58] Field of Search ..... 206/315.2, 315.3, 206/315.6; 211/70.2

[56] References Cited

U.S. PATENT DOCUMENTS

| | | | |
|---|---|---|---|
| 1,271,784 | 7/1918 | Simpson | 206/315.6 |
| 1,849,610 | 3/1932 | Boyce | 206/315.6 |
| 2,436,687 | 2/1948 | Corbett | 206/315.6 |
| 2,539,336 | 1/1951 | Sobers | 211/70.2 X |
| 2,668,721 | 2/1954 | Wright | 280/DIG. 6 X |
| 2,736,357 | 2/1956 | Stamp | 206/315.3 X |
| 4,449,310 | 5/1984 | Kline | 40/11 R |
| 4,860,889 | 8/1989 | Lemieux et al. | 206/315.6 |
| 4,863,019 | 9/1989 | Lewis et al. | 206/315.3 |
| 4,915,547 | 3/1980 | Sidor et al. | 206/315.6 |
| 4,960,212 | 10/1990 | Wu | 211/70.2 |
| 5,199,573 | 4/1993 | Gribovsky | 206/579 |
| 5,230,507 | 7/1993 | White et al. | 273/32 B |
| 5,332,090 | 7/1994 | Tucker | 206/315.3 |
| 5,383,555 | 1/1995 | Weinmeier | 206/315.6 |
| 5,511,660 | 4/1996 | Yamada et al. | 206/315.6 |

*Primary Examiner*—Sue A. Weaver
*Attorney, Agent, or Firm*—David S. Thompson

[57] ABSTRACT

A golf bag club organizer is disclosed for holding golf club irons in a golf bag in a fixed and orderly array, and for keeping the clubs in place even when the bag is inverted. The golf club organizer provides a first bracket carrying seven forks, each fork having two dissimilar prongs that grasp the head of a golf club iron, keeping a golf club iron fixed in place. A second bracket provides an array of adjustment holes, and may be bolted onto the first bracket after the combined length of the brackets has been adjusted to be equal to the diameter of the rim about the opening of a golf club bag. Both brackets provide alligator connectors which connect to the rim of the golf bag, keeping the organizer in place. Each alligator connector provides an inner and an outer jaw having frictionally engaging teeth which grip the rim of the golf club bag. A pair of bolt holes in each alligator connector allows the jaws to be biased together, thereby increasing the friction between the connectors and the rim of the golf bag.

7 Claims, 3 Drawing Sheets

FIG. 3
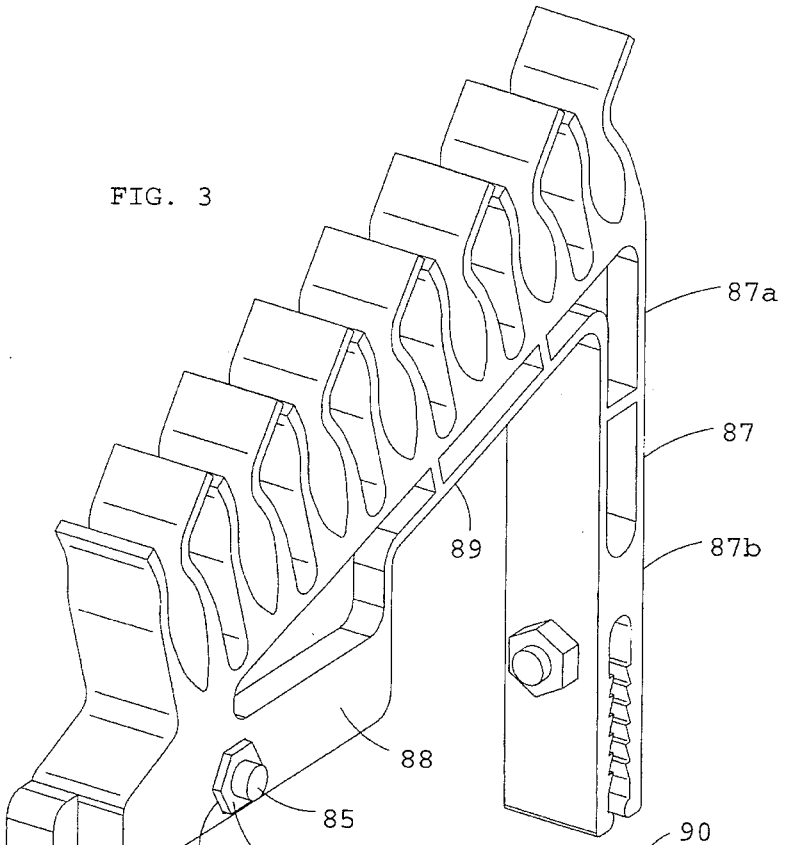
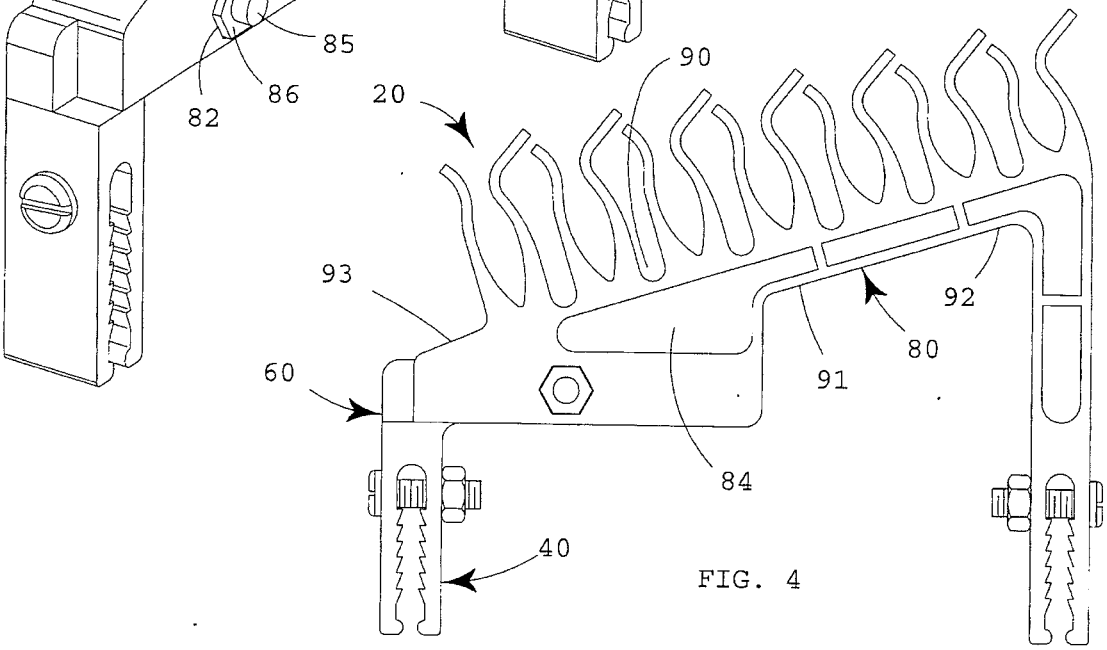
FIG. 4

GOLF CLUB ORGANIZER FOR A GOLF BAG

CROSS-REFERENCES

This application is related to a Provisional Patent Application having application number 60/005,96 and filing date Oct. 11, 1995.

BACKGROUND

Golf is a very popular recreation, requiring players to purchase a set of golf clubs that can be quite expensive. Players typically carry the clubs in a golf bag, which is then transported by means of a carrying strap, a two-wheeled manually-pulled carrier, or a powered golf cart. During transport, it is commonly the case that the expensive clubs collide with each other as they move freely about the bag, potentially causing damage and making it difficult to find any particular club.

As a result, golf club organizers have been developed that attempt to secure the clubs in an orderly fashion and to attach to the opening of a golf club bag. Unfortunately, prior golf club organizers have failed to provide the structures necessary to adequately grip the head of each club. As a result, clubs tend to be released by the organizer prematurely, such as when the golf bag if turned on its side and loaded into the trunk of an automobile. Without gravity to hold the clubs in place, they tend to release from prior golf club organizers.

Another problem with existing golf club organizers is that they fail to adequately grip the golf bag that they are attached to, or require permanent modification of the golf bag to prevent the organizer from becoming detached. The permanent modification may take the form of a bracket or plate that must be screwed permanently into the golf bag, causing irreparable damage.

A further problem with existing golf club organizers is that they tend to be sized to fit a specific golf bag, and are incapable of adjusting to fit smaller or larger bags. As a result, such organizers are less versatile and are not widely used.

What is needed is a golf club organizer that affirmatively grips each club, and holds all clubs in an organized array that allows a player to easily select the club of choice. The golf club organizer must be adjustable so that it may be adapted for use with a variety of golf club bags. The golf club organizer must also be attachable to a golf club bag without doing permanent damage to the bag.

SUMMARY

The instant invention provides novel golf club organizer for a golf bag that retains club irons in an orderly array even when the golf bag is inverted. The golf club organizer may be attached to a golf bag without causing permanent damage. The golf club organizer adjusts to fit variously sized golf club bags.

The golf club organizer of the present invention provides:

(a) An adjustment bracket having a horizontal arm is provided. An array of adjustment holes allows the organizer to be sized to fit any golf club bag.

(b) An angular bracket having a vertical arm, an angular support, and a adjustment bracket receiving cavity. The angular support is at an angle that compensates for the different handle lengths of the different golf club irons. The bracket receiving cavity, having a single bolt hole, allows the angular bracket to be adjustably attached to the adjustment bracket.

(c) An array of seven folks supported on the angular support of the angular bracket. Each fork provides two dissimilar prongs for grasping the head of a golf club. A club face prong provides an outwardly curved prong base, an inwardly curved middle portion, and an outwardly curved tip and holds the face of the head of a golf club. A club back prong provides an outwardly curved prong base, a middle corner portion, and an outwardly directed tip and holds the back of the head of a golf club. Each fork is sized and shaped to grasp the head of a golf club and holding it firmly. Each fork is made of a material that is resiliently deformable, and may be flexed slightly when a golf club is inserted or removed.

(d) Alligator connectors are mounted on the lower portion of the vertical arm of the angular bracket and on the outer end portion of the adjustment bracket. Each alligator connector provides an inner jaw and an outer jaw. Each jaw provides teeth to frictionally engage the golf bag. In use, the inner jaw grasps the inner surface of the rim of the golf bag, while the outer jaw grasps the outer surface of the rim of the golf bag. A pair of bolt holes, one hole through each jaw, allows a bolt to be used to bias the jaws together, thereby increasing the frictional attachment Of the alligator connector to the rim of the golf bag.

It is therefore a primary advantage of the present invention to provide a novel golf club organizer for a golf bag that iS adjustable to fix a variety of differently sized golf club bags.

Another advantage of the present invention is to provide a golf club organizer for a golf bag that provides an affirmative grasping means that grasp golf clubs with sufficient strength that they will not fall out if the bag is inverted or laid on its side.

Another advantage of the present invention is to provide a golf club organizer for a golf bag that attaches to a golf bag in a manner that does no permanent damage to the bag.

A still further advantage of the present invention is to provide a golf club organizer for a golf bag that is easily and inexpensively manufactured, is durable and rugged, and is easily and conveniently used.

DRAWINGS

These and other features, aspects, and advantages of the present invention will become better understood with regard to the following description, appended claims, and accompanying drawings where:

FIG. 3 is a perspective view of the Back side of the golf club organizer of FIG. 1;

FIG. 4 is an isometric view of the back side of the golf club organizer of FIG. 1;

DESCRIPTION

Figure 1:
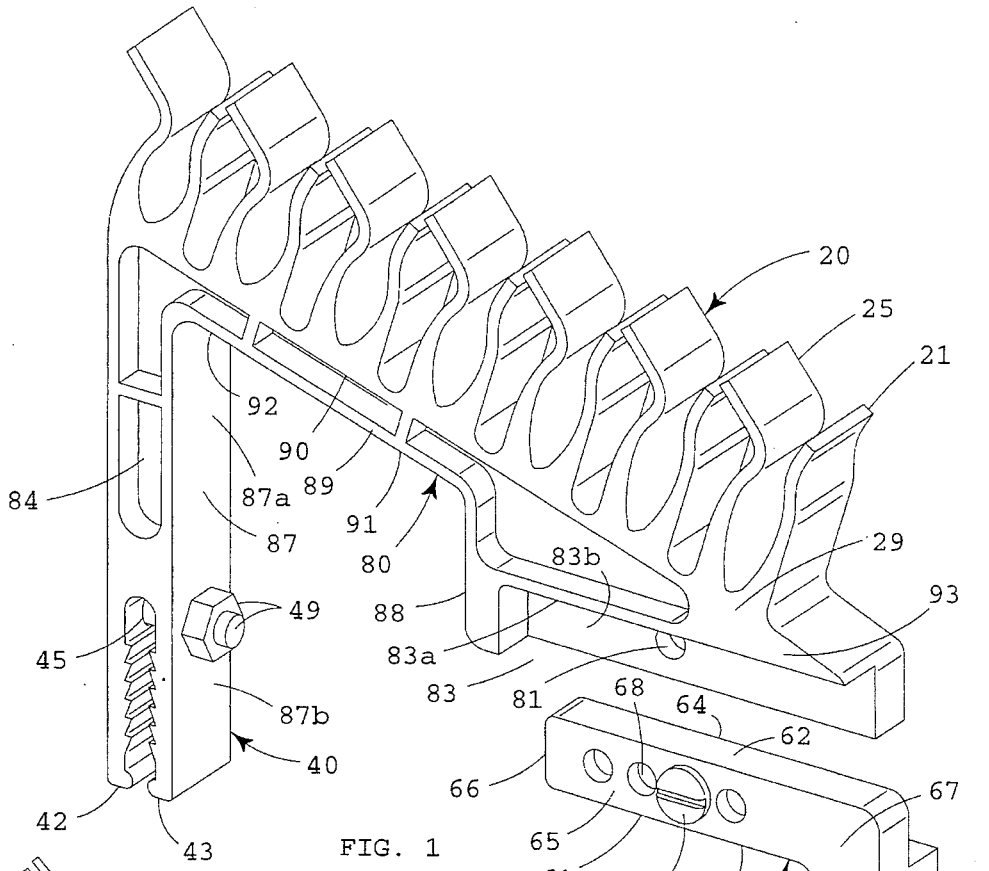
FIG. 1 is a perspective view of a version Of the front of the golf club organizer for a golf bag of the invention having the adjustment bracket removed from the angular bracket to show the details of the structures.
Figure 2:
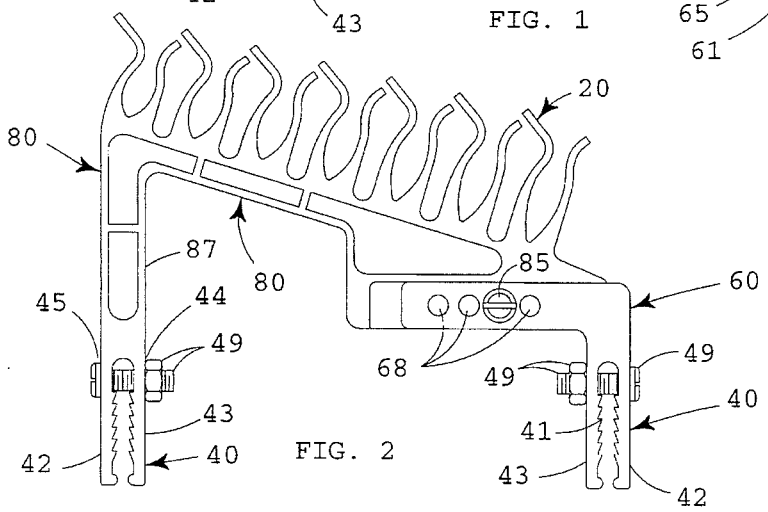
FIG. 2 is an isometric view of the front of the golf club organizer of FIG. 1.

Referring in particular to FIG. 1, a golf club organizer constructed in accordance with the principles of the invention is seen. The golf club organizer holds golf club irons in a fixed and orderly array, keeping the clubs in place even when the bag is inverted. The golf club organizer provides an angular bracket 80 carrying seven forks 20, each fork having two dissimilar prongs 21, 25 that grasp the head 121 of a golf club iron 120, keeping the golf club iron fixed in place.. An adjustment bracket 60 provides an array of adjustment holes 68, and may be bolted onto the angular bracket 80 after the combined length of the brackets 60, 80 has been adjusted to be equal to the diameter of the rim 102 about the opening 101 of a golf club bag 100. Both brackets 60, 80 provide downwardly directed alligator connectors 40 which connect to the rim of the golf bag, keeping the organizer in place. Each alligator connector 40 provides an inner 43 and an outer jaw 42 having frictionally engaging teeth 41 which grip the rim of the golf club bag. A pair of bolt holes 44, 45 in each alligator connector allows the jaws to be biased together, thereby increasing the friction between the connectors and the rim of the golf bag.

As seen in FIG. 1, the angular bracket 80 provides a vertical arm 87 and an angular support 89 and a wedge-shaped region 88. The vertical arm 87 provides an upper portion 87*a* and a lower portion 87*b*, as seen in FIG. 3. The wedge-shaped region 88 defines an elongate, generally horizontally oriented adjustment bracket receiving cavity 83 having interior dimensions sized incrementally larger than the exterior dimensions of the adjustment bracket 60. The adjustment bracket receiving cavity 83 comprises an upper surface 83*a* and a side surface 83*b* which allows adjustment against the horizontal arm 61 of the adjustment bracket 60. Contact between the upper surface 62 of horizontal arm 61 and the upper surface 83*a* of the adjustment bracket receiving cavity 83 prevents the adjustment bracket 60 from rotating about the adjustment bolt 85. The angular support 89 has an upper surface 90, a lower surface 91, an upper end 92 and a lower end 93, as seen in FIG. 4.

The angular bracket 80 typically provides a single adjustment bolt hole 81 positioned in the side surface 83b of the adjustment bracket receiving cavity 83 so that an adjustment bolt 85 passing through bolt hole 81 goes through cavity 83. A countersunk hole 82 is sized to allow a nut 86 to be inserted.

A number of cavities 84 reduce the mass of plastic required, and make the angular bracket 80 lighter weight and less expensive to produce.

Adjustment bracket 60 provides a horizontal arm 61 which is sized to slide within adjustment bracket receiving cavity 83 of the angular bracket 80. As seen in FIG. 1, horizontal arm 61 provides an array of adjustment holes 68. In the preferred embodiment, four adjustment holes are provided. Referring to FIG. 1, it can be seen that the horizontal arm 61 of the adjustment bracket 60 has an upper surface 62 , a lower surface 63, an inner surface 64, and an outer surface 65. The horizontal arm also provides an inner end portion 66 and an outer end portion 67 that is typically located above the rim of the bag.

Figure 5:
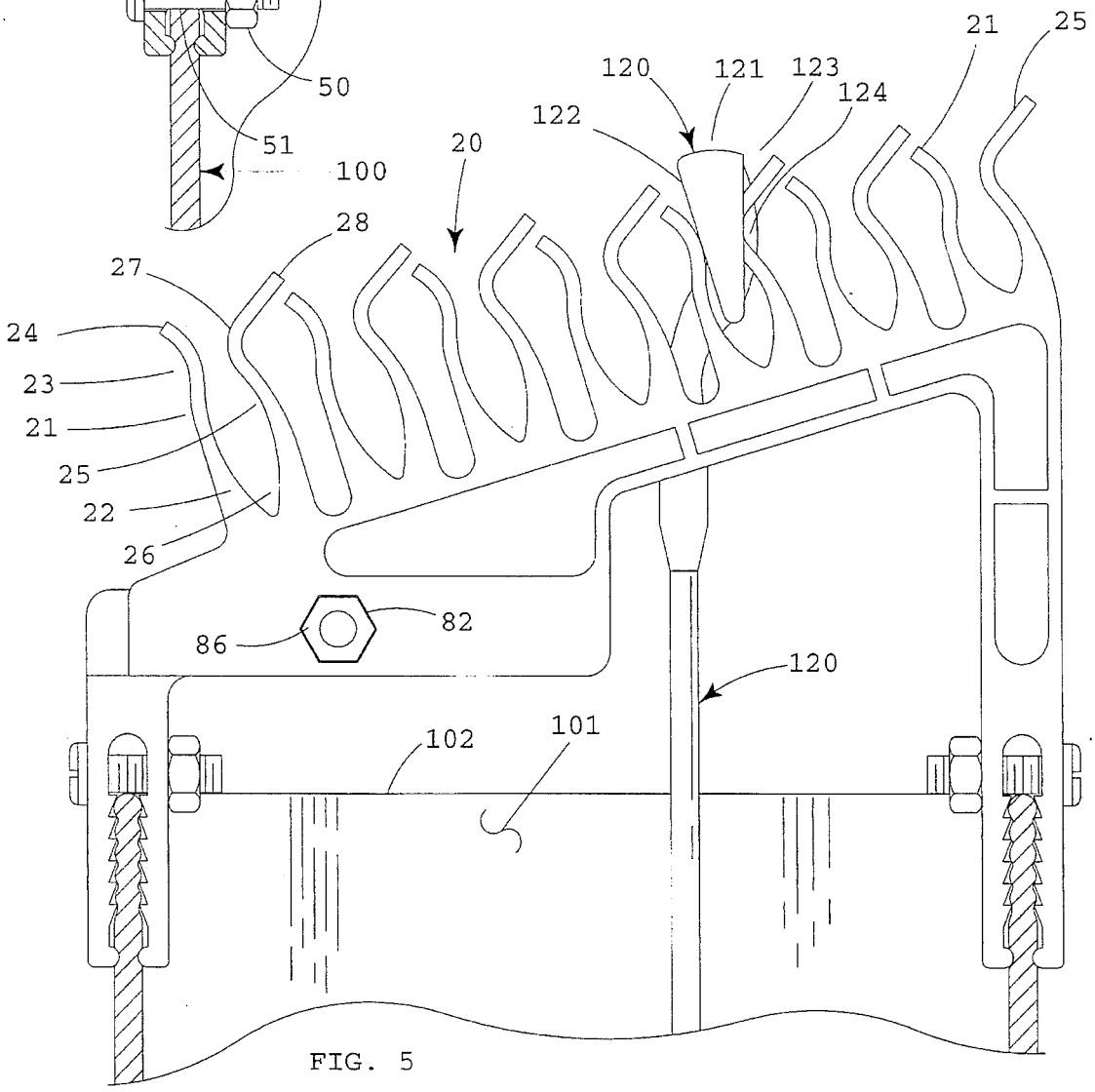
FIG. 5 is an isometric view of the back side of the golf club organizer of FIG. 1, showing the golf bag attached to the golf club organizer, and showing a iron club inserted into one of the forks.

As seen in FIG. 5, brackets 60, 80 are attached to the rim 102 of golf bag 100 by alligator connectors 40. Each alligator connector 40 provides an outer jaw 42 that is generally mounted on the outer portion of the rim 102 of the golf bag 100, and an inner jaw 43 that is mounted on the inner portion of the rim of the golf bag. Each jaw provides teeth 41, which increase the friction between the jaw and the golf bag. A jaw back 48 is at the junction of the upper and lower jaws. An upper inner bolt hole 44 and an upper outer bolt hole 45 allow an upper bolt and nut 49 to bias the jaws 42, 43 together. Similarly, an optional lower inner bolt hole 46 and an optional lower outer bolt hole 47 allow an optional lower bolt/nut combination 50 to further bias the jaws 42, 43 together. Optional holes 46, 47, and bolt 50 are not provided in the preferred embodiment, however, because a hole 51 must be made in the golf bag 100 to accommodate the lower bolt 50.

In the preferred embodiment, seven forks 20 are supported on the upper surface 90 of the angular support 89 of the angular bracket 80. Each fork provides two dissimilar prongs which are attached to the fork base 29. A club face prong 21 has a shape suited for resting against the face 122 of the head 121 of a golf club iron 120. A club back prong 25 is shaped in a manner suited for resting against hollow area 124 of the back 123 of the head of a golf club iron. The forks 20 are made of a generally rigid plastic that is somewhat resiliently deformable.

Referring to FIG. 5, the club face prong 21 can be seen. The club face prong 21 makes contact with the face 122 of the club 120 when the club is inserted into the fork 20. The club face prong 21 provides an outwardly curved prong base 22, an inwardly curved middle portion 23, and an outwardly curved tip 24. The club back prong 25 makes contact with the hollow area 124 on the back 123 of the head 121 of the club 120 when the club is inserted into the fork 20. The club back prong 25 provides an outwardly curved prong base 26, a middle corner portion 27, and an outwardly directed tip 28. The distance between the middle Corner portion 27 of the club back prong 25 and the inwardly curved middle portion 23 of the club face prong 21 is incrementally greater than the thickness of the head 121 of the club 120. Most clubs have a hollow area 124 in the back 123 of the club that is indented somewhat, and the middle comer portion 27 fits into that indentation.

To install the golf club organizer for a golf bag, the user slides the horizontal arm 61 of the adjustment bracket 60 along the adjustment bracket receiving cavity 83 of the angular bracket 80, until the alligator connectors 40 of each bracket 60, 80 are separated by a distance equal to the diameter of the opening 101 of a golf bag 100. The adjustment bolt is then insert through the hole 81 in bracket 80 and through one hole of the array of holes 68 in bracket 60. A nut 86 is inserted into countersunk hole 82, and the bolt is tightened.

The two alligator connectors 40 are then installed over the rim 102 of the golf bag 100 at diametrically opposite points and upper bolt and nut 49 are installed in upper bolt holes 44, 45. Tightening the upper nut and bolt 49 moves jaws 42, 43 closer together, thereby gripping the rim of the golf bag.

Figure 6:
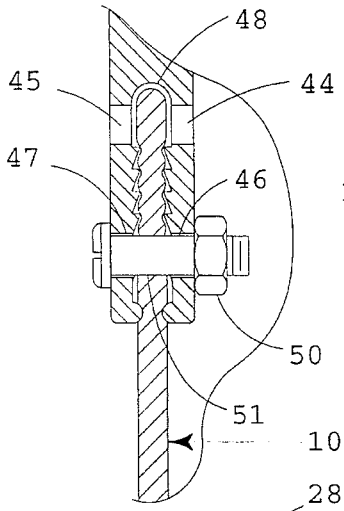
FIG. 6 is a close-up cross-section of a second version of the invention, having a slightly different structure for attachment to a golf bag.

As seen in FIG. 6, a second species of the invention provides an optional lower bolt 50 in the golf bag, and an associated lower inner bolt hole 46 and lower outer bolt hole 47 in jaws 43, 42, respectively. Hole 51 in the golf bag allows bolt 50 to bias the jaws together with greater force than is possible with bolt 49 alone.

After installation, the user may insert seven golf clubs, typically the 3-iron through the 9-iron. Each club is inserted with the club face prong 21 against the face 122 of the club, and the club back prong 25 against the club's back. The club is pressed downwardly, thereby flexing the resilient prongs 21, 25 of the fork 20 apart. As the hollow portion 124 of the club comes into contact with the middle corner 27 of prong 25 the resilient fork 20 returns to its original shape, and the club 120 is firmly held in place.

To remove an iron, the user pulls up On the club, causing the prongs 21, 25 of the fork 20 to flex slightly, releasing the club.

The previously described versions of the present invention have many advantages, including adjustability for any size of opening on any golf bag. Due to the array of adjustment holes on the adjustment bracket, the alligator connectors may be separated by the correct distance to span the opening of the golf bag.

A further advantage of the golf club organizer for a golf bag is that the alligator connectors provide a bolt to bias the jaws of the connectors against the rim of the golf bag, thereby securing the organizer in place.

A still further advantage of the golf club organizer for a golf bag is that the array of forks provide a structure that will hold golf clubs in place even if the bag is inverted.

A still further advantage of the golf club organizer for a golf bag is that the angle bracket supports the array of forks at different distances from the bottom of the golf bag, thereby accommodating the different lengths of the handles of various golf clubs.

Although the present invention has been described in considerable detail and with reference to certain preferred versions, other versions are possible. For example, the exact nature of the interconnection between the adjustment bracket and the angular bracket could be altered while still keeping with the teachings of the invention. Similarly, the exact structure of the prongs of the forks could be altered somewhat, and still function in a similar fashion. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A golf club organizer for a golf bag, comprising:

(a) an adjustment brackets, comprising:

(a) a horizontal arm having an array of adjustment holes and having an outer end portion; and (b) a first downwardly directed alligator connector connected to the outer end portion of the horizontal arm; and (b) an angular bracket, comprising:

(a) a vertical arm, the vertical arm having an upper portion and a lower portion, the lower portion attached to a second downwardly directed alligator connector;

(b) an angular support, the angular support having an upper surface, and an upper end and a lower end, the upper end connected to the upper portion of the vertical arm;

(c) interlocking cavity means for adjustable connection to the adjustment bracket, comprising:

(a) upper and side surfaces, slidable against the horizontal arm of the adjustment bracket; and (b) an adjustment bolt hole in the angular bracket having countersunk hole means for preventing the rotation of a nut;

(d) a plurality of resiliently deformable forks, carried by the upper surface of the annular support, each fork comprising:

(a) a fork base;

(b) a club face prong, attached to the fork base, comprising an outwardly curved prong base, an inwardly curved middle portion, and an outwardly curved tip; and (c) a club back prong, attached to the fork base, comprising an outwardly curved prong base, an middle corner portion, and an outwardly directed tip; and (e) wherein the first and second alligator connectors comprise;

(a) a jaw back;

(b) an outer jaw, having an outer bolt hole, attached to the jaw back;

(c) an inner jaw, having an inner bolt hole, attached to the jaw back;

(d) teeth, carried by the outer jaw and the inner jaw; and (e) biasing means, carried by the inner and outer bolt holes, for biasing the teeth of the inner and outer jaws against the golf bag.

2. A golf club organizer for a golf bag, comprising:

(a) an adjustment bracket, comprising:

(a) a horizontal arm having an array of adjustment holes, and having an inner end portion and an outer end portion; and (b) a first downwardly directed alligator connector connected to the outer end portion of the horizontal arm; and (b) an angular bracket, comprising:

(a) a vertical arm, the vertical arm having an upper portion and a lower portion, the lower portion attached to a second downwardly directed alligator connector;

(b) an angular support, the angular support having an upper surface, and an upper end and a lower end, the upper end connected to the upper portion of the vertical arm;

(c) adjustment bracket receiving cavity means for adjustably connecting to the adjustment bracket; and (d) a plurality of resiliently deformable forks, carried by the upper surface of the angular support, each fork comprising:

(a) a fork base;

(b) a club face prong, attached to the fork base; and (c) a club back prong, attached to the fork base.

3. The golf club organizer of claim 2, wherein the first and second alligator connectors comprise:

(a) a jaw back;

(b) an outer jaw, having an outer bolt hole, attached to the jaw back;

(c) an inner jaw, having an inner bolt hole, attached to the jaw back;

(d) teeth, carried by the outer jaw and the inner jaw; and (e) means, carried by the inner and outer bolt holes, for biasing the teeth of the inner and outer jaws against the golf bag.

4. The golf club organizer for a golf bag of claim 2, in which the adjustment bracket receiving cavity means comprises:

(a) upper and side surfaces, slidable against the horizontal arm of the adjustment bracket; and (b) an adjustment bolt hole in the angular bracket having countersunk hole means for preventing the rotation of a nut.

5. A golf club organizer for a golf bag, comprising:

(a) an adjustment bracket, comprising:

(a) a horizontal arm having an outer end portion; and (b) a first downwardly directed alligator connector connected to the outer end portion of the horizontal arm;

(b) an angular bracket, comprising:

(a) a vertical arm, the vertical arm having an upper portion and a lower portion, the lower portion attached to a second downwardly directed alligator connector;

(b) an angular support, the angular support having an upper surface, and an upper end and a lower end, the upper end connected to the upper portion of the vertical arm;

(c) a plurality of resiliently deformable forks, carried by the upper surface of the angular support, each fork comprising:

(a) a fork base;

(b) a club face prong, attached to the fork base; and (c) a club back prong, attached to the fork base; and (c) adjustment means, having at least one adjustment hole, for adjusting the distance between the first and second alligator connectors to a length equal to the diameter of the opening of the golf bag, comprising adjustment bracket receiving cavity means, carried by the angular bracket, for adjustably connecting to the adjustment bracket.

6. The golf club organizer of claim 5, wherein the first and second alligator connectors each comprise:

(a) a jaw back;

(b) an outer jaw, attached to the jaw back;

(c) an inner jaw, attached to the jaw back; and (d) teeth, carried by the outer jaw and the inner jaw.

7. The golf club organizer of claim 5, wherein the horizontal arm of the adjustment bracket additionally comprises an upper surface, a lower surface, an inner surface and an outer surface.

* * * * *